United States Patent [19]

Pronovost

[11] 4,161,072

[45] Jul. 17, 1979

[54] DITCH DIGGER WITH ADJUSTABLE SIDE WINGS

[76] Inventor: Normand Pronovost, 256 Rte. 159, St. Tite, Canada

[21] Appl. No.: 840,640

[22] Filed: Oct. 11, 1977

[51] Int. Cl.[2] ..... E02F 5/08

[52] U.S. Cl. ..... 37/93; 37/DIG. 16

[58] Field of Search ..... 37/91-93, 37/98, 81, 82, DIG. 16

[56] References Cited

U.S. PATENT DOCUMENTS

| | | | |
|---|---|---|---|
| 2,235,670 | 3/1941 | Chattin | 37/98 |
| 2,453,723 | 11/1948 | Palmer et al. | 37/98 |
| 2,705,379 | 4/1955 | Fruhling | 37/81 |
| 2,746,180 | 5/1956 | Ficken | 37/92 |
| 2,830,515 | 4/1958 | Zayco | 37/92 X |
| 3,021,621 | 2/1962 | Needham | 37/92 |
| 3,261,117 | 7/1966 | Shoemaker et al. | 37/92 |
| 3,510,970 | 5/1970 | Mikhailov et al. | 37/98 X |
| 3,624,826 | 11/1971 | Rogers | 37/92 |

FOREIGN PATENT DOCUMENTS

| | | | |
|---|---|---|---|
| 310978 | 11/1971 | U.S.S.R. | 37/93 |

*Primary Examiner*—Clifford D. Crowder

[57] ABSTRACT

A ditch digger adapted to dig ditches of different cross-sections; such as of different depths and, in particular, with sides at any selected transverse slope within a predetermined range. The ditch digger is characterized by angularly adjustable side wings to define the selected transverse slope and by a digging rotor unit which is pivoted to the supporting frame with an actuation linkage to adjust the depth of digging and to hold the unit in relatively the same upright attitude irrespective of the depth of digging. This ditch digger is adapted to be hitched to a tractor and powered by the latter. The frame is constituted of a boom which connects at the front end to the five-point hitch of the tractor with the digging rotor unit pivotally suspended at the rear end of the boom.

4 Claims, 8 Drawing Figures

DITCH DIGGER WITH ADJUSTABLE SIDE WINGS

The present invention relates to a ditch digger of the tractor implement type.

In U.S. Pat. No. 3,624,826, there is defined a machine of comparable construction. However, this patented machine is strictly intended to clean ditches, not to dig them. This distinctive character and function is produced by skids 49 which support the rotor assembly on the surface of the ground. Obviously, such previous machine is not meant nor constructed to dig ditches, nor, of course, to dig ditches in a particular manner, such as with sides of any desired transverse slope.

It is a general object of the present invention to provide a ditch digger of the above type, which is adapted to dig ditches of different cross-sections.

It is a more specific object of the present invention to provide a ditch digger of the above type, which is adapted to dig ditches of different depths, and in particular, with sides formed with any transverse slope selected within a predetermined range.

It is another object of the present invention to provide a ditch digger of the above type, which includes a digging rotor unit articulated and actuated relative to the supporting frame to vary the depth of digging and to hold the unit in relatively the same upright attitude irrespective of the depth of digging.

The above and other objects and advantages of the present invention will be better understood with reference to the following detailed description of preferred embodiments thereof which are illustrated, by way of example, in the accompanying drawings, in which.

Figure 1:
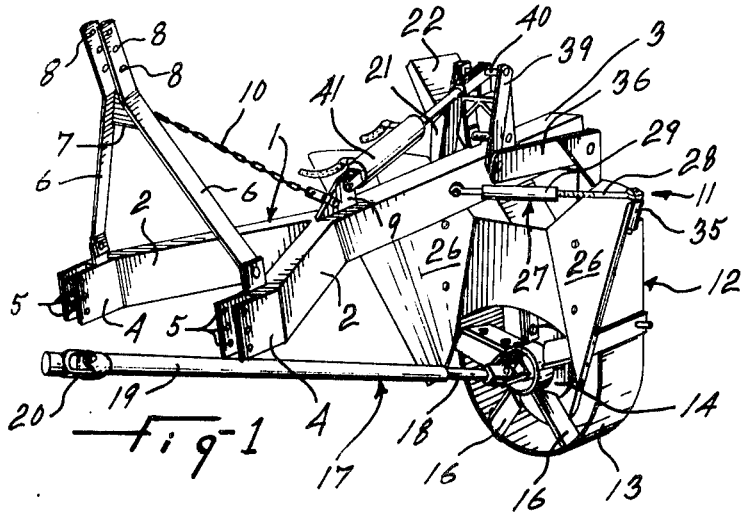
FIG. 1 is a perspective view of a ditch digger according to a first embodiment of the present invention.
Figure 3A:
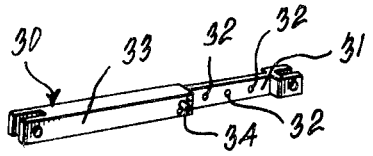
FIG. 3 is a side view of the same ditch digger in inoperative position.
Figure 3:
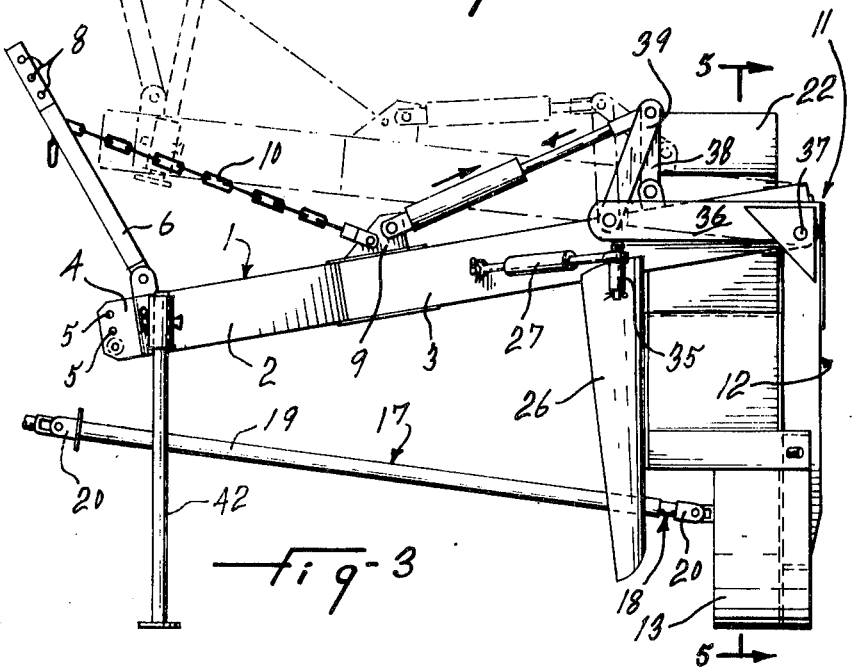
Figure 2:
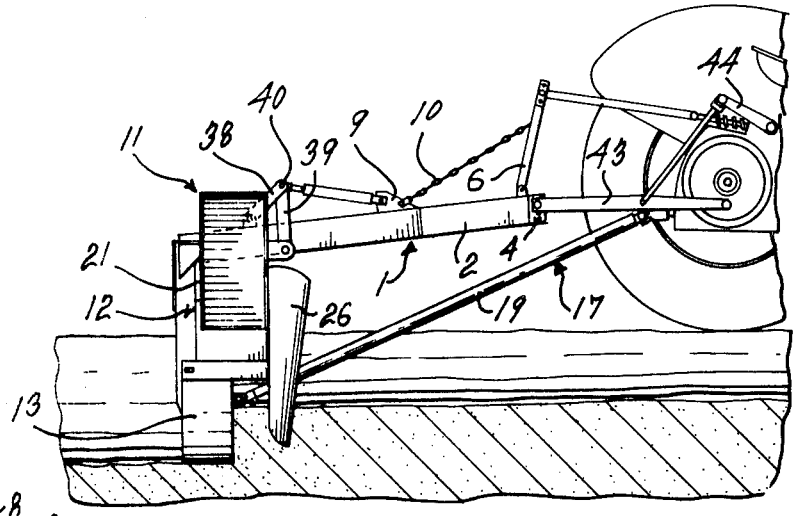
FIG. 2 is a side view of the ditch digger of FIG. 1 in operative digging engagement with the ground.
Figure 4:
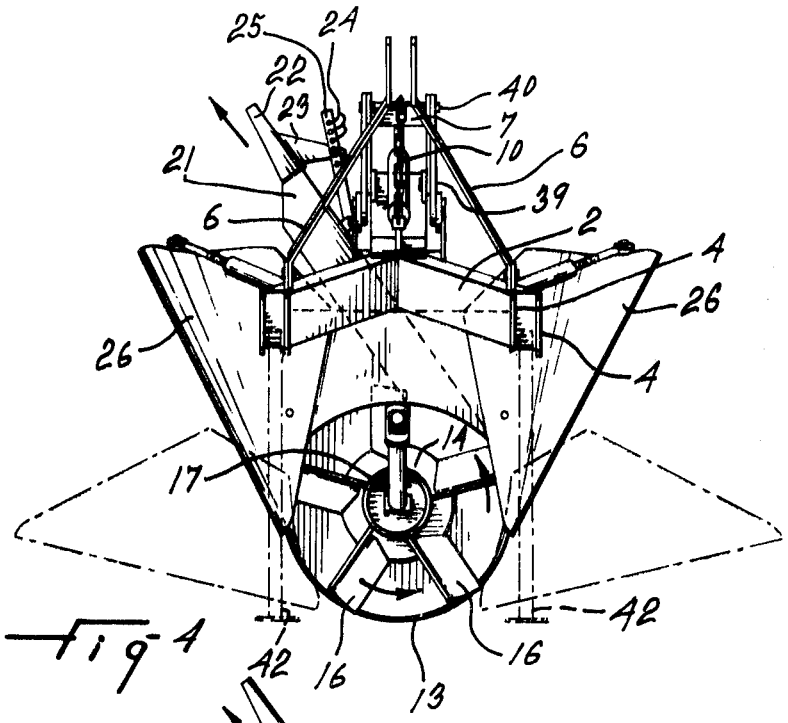
Figure 5:
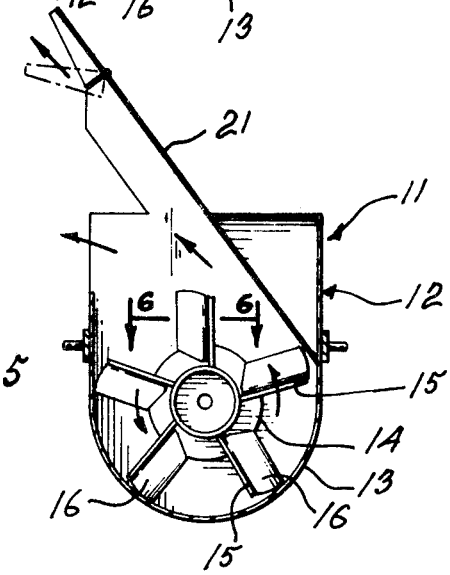
Figure 6:
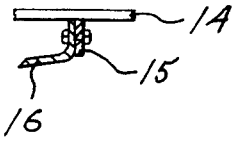

FIG. 3*a* is a perspective view of a longitudinally adjustable arm to be used in alternative in the ditch digger of FIGS. 1, 2, and 3;

FIG. 4 is a front view of the ditch digger of the preceding Figures;

FIG. 5 is a cross-sectional view as seen along line 5—5 in FIG. 3;

FIG. 6 is a cross-sectional view as seen along line 6—6 in FIG. 5; and

Figure 7:
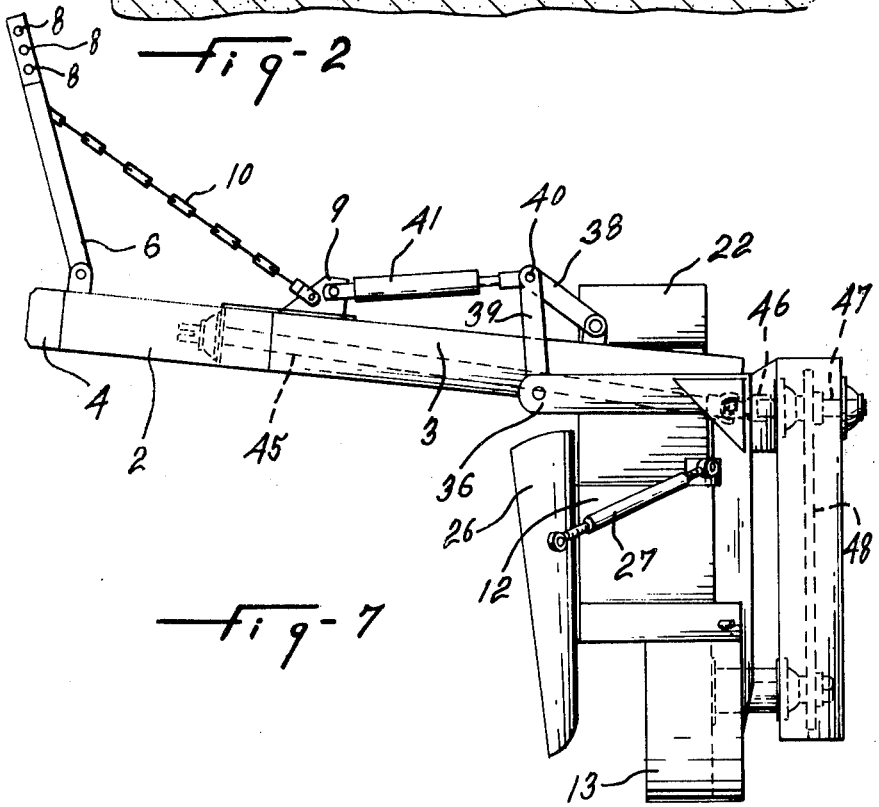

FIG. 7, on the same sheet as FIG. 2, is a side elevation view of a ditch digger according to a second embodiment of the present invention.

The ditch digger illustrated in FIGS. 1 to 6 inclusive comprises an elongated frame 1 constituted of a boom having a Y-shape planar configuration and including a pair of forwardly diverging front branches 2 and a rear projection 3 defining the longitudinal axis of the boom. The branches 2 and the rear projection 3 are of box-shaped construction. The front end of each branch 2 forms a bracket including a pair of laterally spaced-apart flanges 4 with vertical adjustment holes 5 transversely therethrough. A pair of arms 6 are pivotally connected at one end to the branches 2 respectively and are rigidly interconnected at the other end by a plate 7 to form a single connection having adjustment holes 8 for connection to the conventional upper hitch point of a farm tractor. An ear, or lug 9, is rigidly fixed on the rear projection 3 of the boom 1 and a chain 10 is fixed at one end to the lug 9 and selectively engageable in a notch formed in the plate 7. Thus, the effective length of the chain 10 between the lug 9 and the plate 7 may be set by locking engagement of an appropriate link of the chain in the notch of this plate.

The ditch digger further comprises a digging rotor unit 11 including a stator structure and a digging rotor. The stator structure includes a housing 12, the bottom portion of which is transversely shaped to form a shroud 13 for the digging rotor. The latter transversely extends in relatively upright operative attitude. The digging rotor includes a mounting plate 14 having a hub portion fixedly secured to a shaft for rotation therewith about a longitudinal axis longitudinally aligned with the rear projection 3. This shaft, not shown, is rotatably carried by the housing 12 in any appropriate manner. The digging rotor includes radial plates 15 rigidly secured against the front face of the mounting plate 14 for bodily rotation therewith. A cutting or digging blade 16, of L-shape cross-section, is bolted to each radial plate and radially projects coextensive with the shroud 13 and forward of the latter to dig a sufficient cross-section for the passage of the shroud. The digging rotor is adapted to be driven by the power take-off of the pulling tractor through a telescopic shaft 17. The latter includes a male section 18, of square cross-section, and a tubular female section 19 having a longitudinal chamber of square cross-section in which the male section is telescopically engaged. A universal joint 20 is connected at each end of the shaft 17 to connect the latter to the shaft of the digging rotor and to the power take-off of the pulling tractor.

A trough 21 is connected to the housing 12 and communicates with the latter to outwardly expel the earth dug by the digging rotor, upon the centrifugal action produced by the cutting blades 16. A deflector 22 is hinged to the outer end of the trough 21 and is angularly adjustable to adjust the throwing distance of the earth by the digging rotor. For this purpose, the deflector 22 includes a lug 23 rearwardly projecting therefrom and selectively pinned in one of the adjustment holes 24 of an arm 25, as shown in details in FIG. 4.

A pair of grading side wings 26 are adjustably fixed to the housing 12 on opposite sides thereof respectively. Each side wing 26 is provided with a plurality of holes along the inner edge thereof to selectively install the same at a preferred height relative to the digging rotor. Each grading wing 26 is upwardly widening and forwardly curves outward such that the outer straight edge thereof scrapes the corresponding side of the ditch to downwardly feed the loosened material axially forward of the digging rotor. Thus, the loosened material is outwardly expelled by the digging rotor. A tie rod 27, of adjustable length, is connected between the top outer edge of each wing 26 and the boom 1 to angularly set the corresponding wing transversely relative to the digger. Thus, the outer side of each wing will produce the desired transverse slope on the corresponding side of the ditch. As may be seen from FIG. 1, the longitudinal adjustment of the tie rod 27 is obtained by screwing or unscrewing the stem 28 in the internally threaded sleeve 29 of the tie rod.

FIG. 3*a* illustrates a different type of longitudinally adjustable tie rod, the tie rod 30, which is adapted to be used in replacement of the tie rod 27. The tie rod 30 includes a stem 31 having adjustment holes 32 therethrough, and slidably adjustable endwise in the tubular sleeve portion 33, by a pin 34. Either tie rod 27 or 30 is connected to one grading wing 26 by a pin removably engaged in a sleeve 35 welded against the rear side of the wing.

The ditch digger also includes a linkage and actuator assembly connected to the boom 1 and to the digging rotor unit 11 to hold the unit in relatively upright attitude irrespective of the depth of digging. A pair of laterally spaced-apart L-shape arms 36 are fixedly secured to the housing 12, or stator structure, and upwardly project in straddling relationship with the rear projection 3. The digging rotor unit 11 is pivotally suspended to the outer end of the rear projection 3 by a transverse pin at 37. A pair of arms 38 are pivotally connected at one end to the rear projection 3 and another pair of arms 39 are pivotally connected to the front end of the L-shaped arms 37. These arms 38 and 39 are pivotally connected to each other by a transverse pin 40. A hydraulic cylinder 41 is connected at its opposite ends to the fixed ear or lug 9 on the boom 1 and to the transverse pin 40 to selectively pivot the arms 36, 38, and 39.

From FIG. 3 it may be understood that the hydraulic cylinder or actuator 41 serves to maintain the housing 12 in upright attitude irrespective of the inclination of boom 1. Adjustable legs 42 are provided to hold the digger in unhitched rest position.

As shown in FIG. 2, the ditch digger is operatively connected or hitched to a tractor vehicle or farm tractor by connection to the five-point hitch of the tractor and to the power take-off thereof. The five-point hitch includes the pulling lower arms 43 and the elevating upper arms 44 which serve to adjust the depth of digging by lowering arms 43. The depth of digging is also adjustable by proper selection of the adjustment holes 5 in the brackets 4 and by adjusting link 10.

In the second embodiment shown in FIG. 7, the ditch digger comprises mostly the same elements than in the previously described embodiment of FIGS. 1 to 6 inclusive. The elements which are common to both embodiments, are identified by the same reference numerals in all the Figures of the drawings.

The ditch digger of FIG. 7 distinctively comprises a distinct drive replacing the drive elements 17 to 20 of the first embodiment and it also distinctively comprises connection of the tie rods 27 or 30 at the rear of the side wings 26, between the latter and the housing 12.

The drive elements in the second embodiment distinctively includes a shaft 45, which longitudinally extends, and is rotatively carried, in the rear projection 3. The rear of the shaft 45 is connected by a universal joint 46 to a shaft 47. The shaft of the digging rotor rearwardly projects parallel to the shaft 47 and underlies the latter. A chain 48 and a pair of sprocket wheels, not shown, transfer the rotation of the shaft 47 to the shaft of the digging rotor.

It should be understood that many changes in the details of construction are possible without departing from the spirit and scope of the present invention, and fall within the scope of protection defined by the appended claims.

Effectively, a ditch digger made according to the present invention had its digging rotor radially sinkable to axially dig any ditch from 12 inches to 36 inches deep and with sides having a transverse slope up to 35°. This ditch digger was effective in hard and even frozen ground.

What I claim is:

1. A ditch digger comprising a frame defining a longitudinal direction and a pair of opposite ends in said longitudinal direction, said frame comprising a boom having a Y shape planar configuration and including a pair of front branches forwardly diverging from each other and a rear projection, connection means operatively connecting said frame to a tractor vehicle, said connection means including the outer end of said branches being constructed and arranged for pivotal connection to lower hitch arms of a tractor, a pair of arms pivotally connected to said front branches respectively and to an upper hitch point of a tractor, and an adjustable link angularly suspending said boom relative to said pair of arms, a digging rotor unit carried by said rear projection and including a stator structure and a digging rotor, the latter being rotatively carried by said stator structure for transverse rotation about an axis extending in said longitudinal direction, and having a lower half radially sinkable in operatively axial digging engagement with the ground, and a pair of grading blades laterally projecting on the opposite sides respectively of the stator structure and angularly adjustable laterally outward relative to said lower half for selective transverse sloping of the sides of the ditch, said digging rotor unit being pivotally suspended at the end of said rear projection, a linkage system and an actuator connected to said digging rotor unit and to said frame and operatively articulating the same vertically relative to each other constructed and arranged to maintain said digging rotor in relatively the same upright attitude irrespective of the depth setting of said digging rotor unit.

2. A ditch digger as defined in claim 1, wherein a pair of longitudinally adjustable tie rods are connected to said grading blades respectively and transversely set the latter angularly relative to said digging rotor unit according to the required transverse slope of the sides of the ditch.

3. A ditch digger as defined in claim 2, wherein said adjustable link constitutes a chain adjustably set in effective length in relation to the tractor and the desired angular attitude of said boom lengthwise thereof relative to the ground.

4. A ditch digger as defined in claim 3, further including an earth ejector trough fixed to said digging rotor unit and angularly settable transversely of the ditch relative to the digging rotor in relation with the desired distance of lateral ejection of the earth under the centrifugal impeller action of the digging rotor.

* * * * *